US007601925B1

(12) United States Patent
Li et al.

(10) Patent No.: US 7,601,925 B1
(45) Date of Patent: Oct. 13, 2009

(54) FIXING DEVICE FOR BUTTON

(75) Inventors: Lian-Chen Li, Shenzhen (CN); Guang-Yao Lee, Taipei Hsien (TW); Pin-Shian Wu, Taipei Hsien (TW); Hsuan-Tsung Chen, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/266,560

(22) Filed: Nov. 7, 2008

(30) Foreign Application Priority Data

Jun. 4, 2008 (CN) ..... 2008 1 0302025

(51) Int. Cl.
*H01H 13/04* (2006.01)
*H01H 13/14* (2006.01)
*H01H 13/70* (2006.01)

(52) U.S. Cl. ..... 200/293; 200/333; 200/338; 200/341; 200/345

(58) Field of Classification Search ..... 200/293–295, 200/302.2, 302.3, 329, 330, 332.1, 333, 338, 200/341, 345
See application file for complete search history.

(56) References Cited

U.S. PATENT DOCUMENTS 6,192,815 B1 * 2/2001 Duttenhofer ..... 112/277
7,402,765 B2 * 7/2008 Yu ..... 200/5 A

FOREIGN PATENT DOCUMENTS

EP 744886 A1 * 11/1996

* cited by examiner

*Primary Examiner*—Ramon M Barrera
(74) *Attorney, Agent, or Firm*—Zhigang Ma

(57) ABSTRACT

A fixing device for mounting a button having a switch includes a base defining a though hole for receiving the switch, two first mounting walls adjacent to the through hole configured for clipping the button, a second mounting wall adjacent to the through hole and including a first blocking portion, an elastic piece adjacent to the through hole, and a third mounting wall extending from the elastic piece and including a second blocking portion. The first mounting walls are spaced by the through hole and located at two opposite sides of the through hole. Each first mounting wall includes a hook. The hooks are opposite to each other configured for clipping the button. The second mounting wall and the elastic piece are located at another two opposite sides of the through hole. The first blocking portion and the second blocking portion are configured for blocking the button therebetween.

16 Claims, 3 Drawing Sheets

FIXING DEVICE FOR BUTTON

BACKGROUND

1. Technical Field

The disclosure relates to buttons and, more particularly, to a fixing device for a button.

2. Description of Related Art

Buttons are common elements of an electronic apparatus. For example, a button can be mounted to a front bezel of a computer to control some aspect of the computer. A control button is normally mounted to a fixing device, which is fixed to the bezel. However, repeated use of the button over time may cause the button to loosen relative to the fixing device and stop functioning properly.

DETAILED DESCRIPTION

Figure 1:
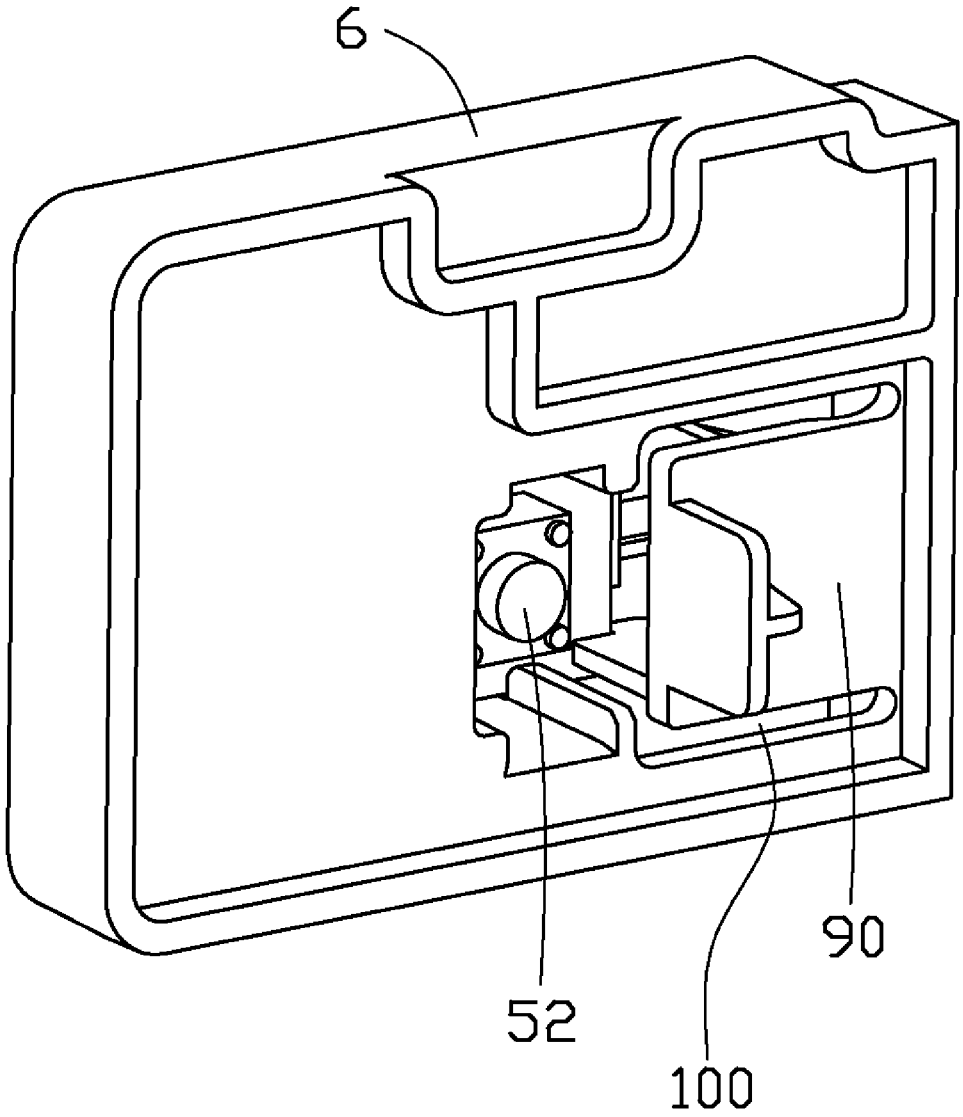
FIG. 1 is an assembled, isometric view of a fixing device and a button.
Figure 2:
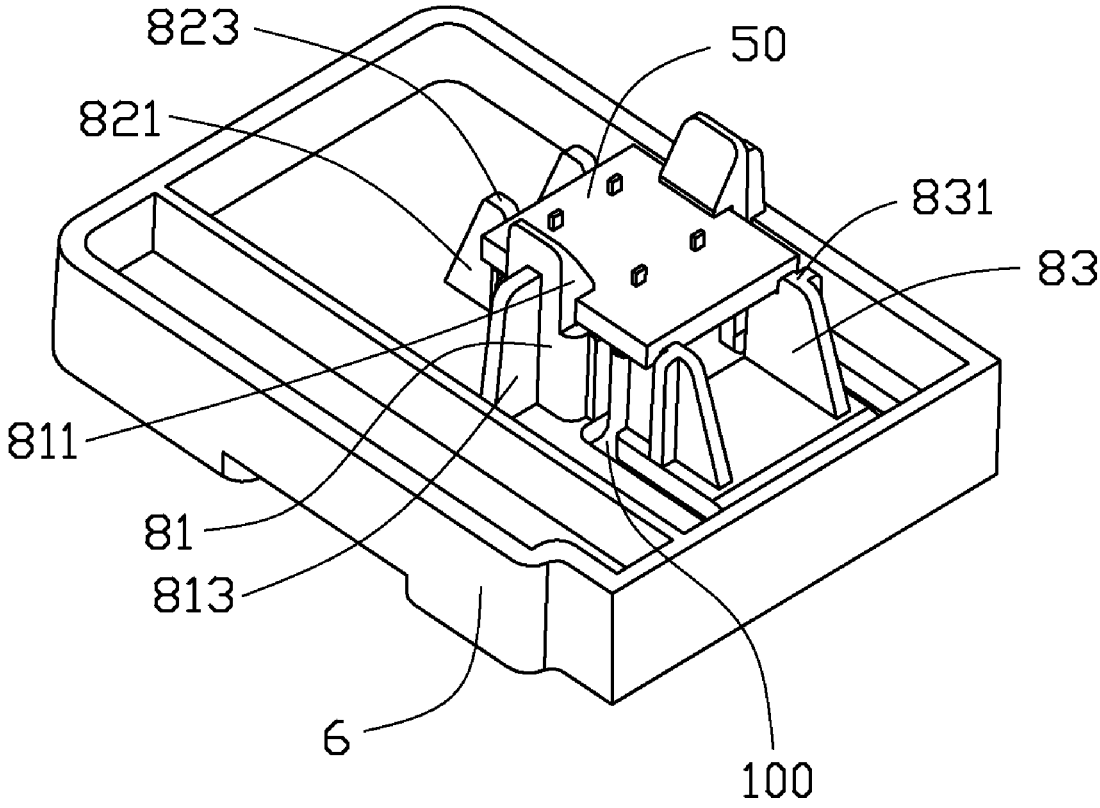
FIG. 2 is similar to FIG. 1, but viewed from another perspective.
Figure 3:
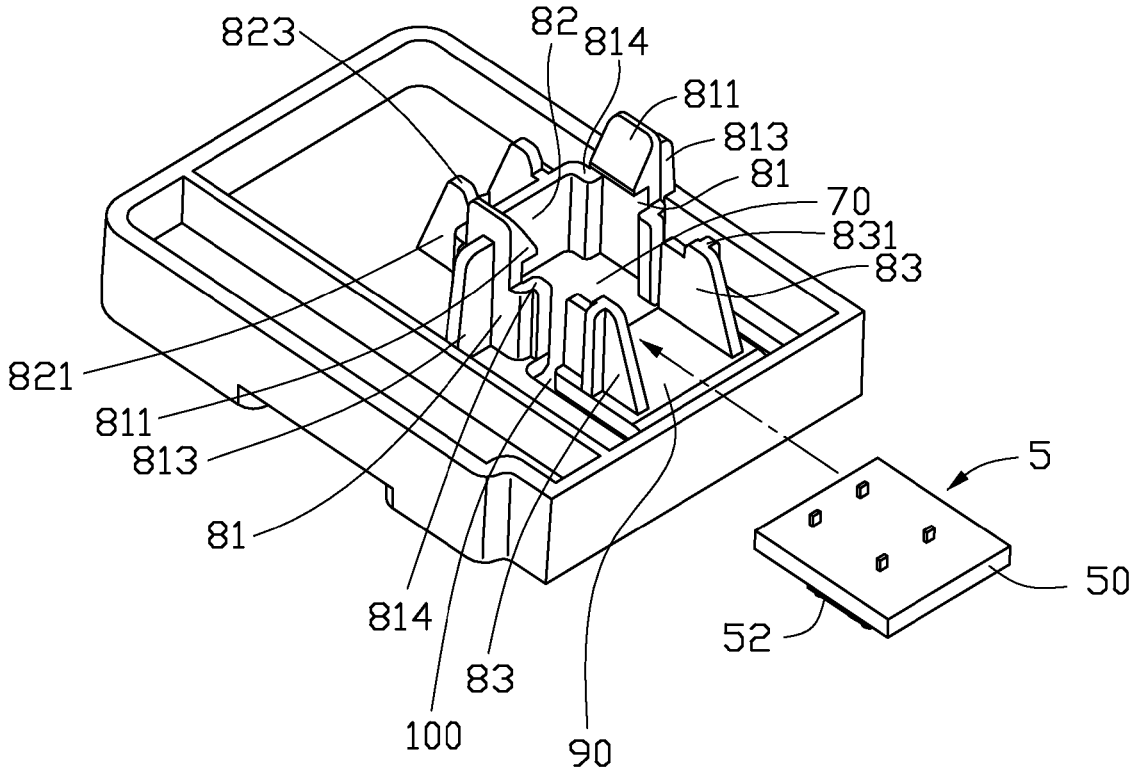
FIG. 3 is a disassembled view of FIG. 2.

Referring to FIGS. 1 to 3, a fixing device is provided in accordance with an embodiment of the disclosure for mounting a button 5. The button 5 includes a circuit board 50, and a switch 52 fixed to the circuit board 50.

The fixing device includes a base 6. A through hole 70 is defined in the base 6. Two opposite first mounting walls 81 perpendicularly extend from the base 6 and adjacent to the through hole 70 and located at opposite sides of the through hole 70. Two support portions 814 extend from opposite edges of each first mounting wall 81. A hook 811 extends from a free end of each first mounting wall 81. Each first mounting wall 81 further includes a reinforcing rib 813, integrally extending from the base 6 and connecting the first mounting wall 81 and the corresponding hook 811, configured for strengthening the rigidity of the first mounting wall 81 and the corresponding hook 811, thus preventing the first mounting wall 81 and the corresponding hook 811 from being deformed. A second mounting wall 82 perpendicularly extends from the surface of the base 6 and adjacent to the through hole 70. An elastic piece 90 parallelly extends from the base 6 and adjacent to the through hole 70. The second mounting wall 82 and the elastic piece 90 are located at opposite sides of the through hole 70. Opposite edges of the second mounting wall 82 are integrally connected with the two first mounting walls 81 respectively via the corresponding support portions 814. Two reinforcing ribs 821 extend from the second mounting wall 82. A free end of each reinforcing rib 821 extends beyond a free end of the second mounting wall 82 thereby forming a first blocking portion 823. The elastic piece 90 is formed via defining a U-shaped slot 100 in the base 6 in communication with the through hole 70. Two third mounting walls 83 perpendicularly extend from the elastic piece 90. The third mounting walls 83 are parallelly aligned with the first mounting walls 81. A second blocking portion 831 extends from a free end of each third mounting wall 83 and is adjacent to a side of the corresponding third mounting wall 83 away from the through hole 70.

In assembly, the second blocking portions 831 are pressed downwards by the circuit board 50, thereby making the elastic piece 90 deform to deviate from its original position. Then the circuit board 50 is slid generally parallel to the base 6 to move beyond the second blocking portions 831 and be supported by the first, second, and third mounting walls 81, 82, and 83, while the switch 52 goes through a space between the two third mounting walls 83 and is received in the through hole 70. The circuit board 50 slides in guideways formed between the hooks 811 and the top of the corresponding support portions 814. Then the elastic piece 90 restores back to its original position. Thus, as shown in FIG. 2, the circuit board 50 is clipped between the hooks 811 and the support portions 814, so that motion of the button 5 along a direction perpendicular to the base 6 is limited by the support portions 814, the second mounting wall 82, the third mounting walls 83, and the hooks 811. The circuit board 50 is blocked between the two hooks 811 and between the first blocking portions 823 and the second blocking portions 831, so that motion of the button 5 along a direction parallel to the base 6 is limited by the first blocking portions 823, the second blocking portions 831, and the hooks 811.

In use, a cap (not shown) can be received in the through hole 70 for pressing the switch. Because the elements, except the elastic piece 90, of the fixing device for mounting the button 5 are stiff, the button 5 will not loosen along the direction that the cap presses the switch.

It is to be understood, however, that even though numerous characteristics and advantages of the disclosure have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fixing device for mounting a button comprising a switch, the fixing device comprising:

a base defining a through hole capable of receiving the switch;

two first mounting walls extending from the base and adjacent to the through hole configured for clipping the button, the two first mounting walls being spaced by the through hole and located at two opposite sides of the through hole, each of the first mounting walls comprising a inflexible hook, the hooks being opposite to each other and configured for clipping the button;

a second mounting wall extending from the base and adjacent to the through hole and comprising a first blocking portion;

an elastic piece extending from the base and adjacent to the through hole; and a third mounting wall extending from the elastic piece and comprising a second blocking portion;

wherein the second mounting wall and the elastic piece are located at another two opposite sides of the through hole, and the first blocking portion and the second blocking portion are configured for blocking the button therebetween.

2. The fixing device of claim 1, wherein the elastic piece is formed via defining a U-shaped slot in the base.

3. The fixing device of claim 1, wherein each of the first mounting walls comprises a reinforcing rib configured for preventing the first mounting wall and the corresponding hook from being deformed.

4. The fixing device of claim 1, wherein each of the first mounting walls comprises two support portions extending from opposite edges thereof and configured for supporting the button.

5. The fixing device of claim 1, wherein the second mounting wall comprises a reinforcing rib.

6. The fixing device of claim 5, wherein the first blocking portion extends form the reinforcing rib.

7. The fixing device of claim 1, wherein the third mounting wall is parallel with the first mounting walls.

8. A fixing device for mounting a button comprising a switch, the fixing device comprising:

a base defining a though hole capable of receiving the switch;

two first mounting wall extending from the base and adjacent to the through hole configured for clipping the button, the two first mounting walls being spaced by the through hole and located at two opposite sides of the through hole, each of the first mounting walls comprising a hook and a support portion;

a first blocking portion extending from the base and adjacent to the through hole;

an elastic piece formed in the base; and a second blocking portion extending from the elastic piece and adjacent to the through hole;

wherein the first blocking portion and the second blocking portion are located at another two opposite sides of the through hole; and wherein the hooks, and support portions are configured for limiting motion of the button along a direction perpendicular to the base; and wherein the first blocking portion, the second blocking portion, and the hooks are configured for limiting motion of the button along a direction parallel to the base.

9. The fixing device of claim 8, wherein the elastic piece is formed via defining a U-shaped slot in the base.

10. The fixing device of claim 8, wherein each of the first mounting walls comprises a reinforcing rib integrally extending from the base and connecting the first mounting wall and the corresponding hook.

11. The fixing device of claim 8, further comprising a second mounting wall extending from the base configured for supporting the button.

12. The fixing device of claim 11, wherein the second mounting wall comprises a reinforcing rib.

13. The fixing device of claim 12, wherein the first blocking portion extends form the reinforcing rib.

14. The fixing device of claim 8, further comprising a second mounting wall extending from the elastic piece configured for supporting the button.

15. The fixing device of claim 14, wherein the second blocking portion extends form the second mounting wall.

16. The fixing device of claim 15, wherein the second mounting wall is parallel with the first mounting walls.

* * * * *